United States Patent [19]

George et al.

[11] Patent Number: 4,510,999

[45] Date of Patent: Apr. 16, 1985

[54] WELL CLEANUP AND COMPLETION METHOD AND APPARATUS

[75] Inventors: Flint R. George, Katy, Tex.; Emmet F. Brieger, Albuquerque, N. Mex.

[73] Assignee: Geo Vann, Inc., Houston, Tex.

[21] Appl. No.: 385,708

[22] Filed: Jun. 7, 1982

[51] Int. Cl.[3] ..... E21B 43/11

[52] U.S. Cl. ..... 166/297; 166/387

[58] Field of Search ..... 166/297, 55, 55.1, 63, 166/297, 312, 317, 387, 128, 133, 158; 175/4.52, 4.56

[56] References Cited

U.S. PATENT DOCUMENTS

| | | | |
|---|---|---|---|
| 2,530,966 | 11/1950 | Huber | 175/4.56 |
| 2,836,247 | 5/1958 | McCulloch | 166/297 |
| 2,986,214 | 5/1961 | Wiseman, Jr. et al. | 166/297 |
| 3,029,732 | 4/1962 | Greene | 166/63 |
| 4,040,482 | 8/1977 | Vann | 166/297 |
| 4,279,306 | 7/1981 | Weitz | 166/312 |
| 4,299,287 | 11/1981 | Vann et al. | 166/297 |
| 4,372,384 | 2/1983 | Kinney | 166/297 |

*Primary Examiner*—Stephen J. Novosad

*Assistant Examiner*—William P. Neuder

[57] ABSTRACT

A cased borehole has a perforating gun suspended in underlying relationship relative to a packer device. A tubing string has a seal assembly connected to the lower end thereof, and an extension tube downwardly extends from the seal assembly. A seal housing is connected to the packer and receives the seal assembly therewithin. The tubing string is run downhole until the end of the extension tube is in proximity of a gun firing head while the seal assembly is unseated from the housing, so that the fluid in proximity of the gun firing head is displaced with clean fluid which flows from the surface, down the tubing string, and out of the end of the extension tube. After the gun firing head is cleaned, the tubing is lowered, the seal assembly is sealingly received within the seal housing, and the gun firing head is actuated by lowering a gun firing device down through the interior of the tubing string, seal assembly, and extension tube, thereby perforating the casing so that production flows from a payzone, through the perforations, into the lower annulus, through a one-way valve of the seal housing, and up the tubing string to the surface of the earth.

9 Claims, 5 Drawing Figures

WELL CLEANUP AND COMPLETION METHOD AND APPARATUS

REFERENCE TO RELATED APPLICATIONS

This application is one of a group of patent applications assigned to a common assignee all contemporaneously filed and relating to bottom hole completions, including patent application Ser. No. 384,508 filed June 3, 1982, entitled "Gun Below Packer Completion Tool String"; patent application Ser. No. 385,707 filed June 2, 1982, entitled "Gun Firing System Using Fluid Filled Pressure Balance Tubing"; and patent application Ser. No. 383,746 filed June 1, 1982, entitled "Well Cleanup and Completion Apparatus". Other related patents and applications of assignee include U.S. Pat. No. 4,040,482, entitled "Optional Fire and Release Tool and Method" and U.S. patent application Ser. No. 175,515, filed Aug. 5, 1980, entitled "Ball Switch Revice and Method". These cited patents and application and the art cited with respect thereto are presented to the U.S. Patent and Trademark Office in order to make disclosure of Applicant's prior art knowledge.

BACKGROUND OF THE INVENTION

After a borehole has penetrated a formation and a casing has been cemented in place, the hydrocarbon containing formation must be communicated with the wellhead so that valuable hydrocarbons can be extracted from the wellbore. Roy R. Vann U.S. Pat. Nos. 3,706,344 and 3,871,448 teach a permanent completion technique which can advantageously be employed in completing a borehole. Reference is made to these prior patents, to U.S. Pat. Nos. 3,931,855; 3,812,911; and 4,040,485; and to the art cited therein for further background of the present invention.

The well completion method and apparatus of the present invention is particularly applicable to deep, high-temperature, high-pressure wells. For example, such a well might be over 10,000 feet deep, have a bottomhole temperature of about 300° F., and bottomhole pressure of over 5,000 psi. Because of this environment, it is essential for safety reasons that control be maintained over the well. Such control is maintained by using a hydrostatic head of well fluids such as mud to insure that the bottomhole pressure exceeds the formation pressure and later setting a packer in the cased borehole.

The hydrostatic head of drilling mud is maintained in the well to control the high-pressure production zone. The object is to prevent a blowout of the well. Any replacement of the mud with a lighter clean fluid prior to the setting of the packer removes the margin of safety. Thus, it is desirable to keep heavy mud in the well for as long as possible to insure that the production zone is killed even if there is a casing leak, for example. Once the packer has been set and the cased borehole can be sealed off, the margin of safety can be maintained. The hydrostatic head is still maintained in the annulus above the packer.

A permanent packer is almost always used in a deep, hot, high-pressure well. A permanent packer will contain and withstand the temperatures and pressures of such a well since a permanent packer is a more heavy duty packer. Thus, very few customers will permit a retrievable packer in such a well where the retrievable packer is mounted on a tubing string with a perforating gun. Such a packer is considered not strong enough to insure the control of the differential pressures and high temperatures in the well. For example, such a packer might fail after the mud was removed with a lighter fluid in the tubing string or where the tubing string is swabbed dry in preparation for perforation. A retrievable packer, mounted on a tubing string with a perforating gun, is generally inadequate for a well with this environment.

The tool string with permanent packer, perforating gun, and other associated apparatus may be run into the well either on a wireline or on a tubing string. It is much more convenient to run the permanent packer in on a wireline rather than a tubing string, however, since less rig time is used. If a tubing string is used, one must come back out of the hole after the packer is set. Once out of the hole, the packer setting tool is taken off the tubing string and then a sealing nipple is run back into the well. This procedure adds almost another day to the well completion.

Although the wireline is preferred, the tool string may have to be lowered on a tubing string where the tool string is very heavy, as for example, with a heavy, long perforating gun or a string of perforating guns. In using a tubing string to lower and set the permanent packer and tool string, the tubing string is released from the permanent packer and removed from the well after the packer has been set.

When a permanent packer, such as described, is required because of the well environment, the tool string is not a closed system, i.e., such as with a packer operated vent assembly that is closed until the packer is set and thus keeps mud out of the string. There must be a flow path for circulation to remove the mud. Such a flow path must be available upon running the packer into the hole. Thus, the tool string on the permanent packer completely fills up with drilling mud as it is run into the hole and left in the hole for a long period of time prior to completing the well. The tool string is completely surrounded with drilling mud from the mud in the well.

Thus, it is often desirable to be able to carry out the necessary steps to suspend a perforating gun from a permanent packer device while the drilling rig is on location, and to complete the well at some subsequent time. There are also advantages in running in and setting the permanent packer with the tool string in the well and leaving the tool string downhole for several days before completing the well. It may be desirable to leave the downhole dormant for a period of time. For example, one may wish to leave the downhole dormant until one is prepared to complete several wells and tie them all in at one time. However, when a string of tools is left downhole in a borehole, the surrounding mud often contaminates the interior of the tool. This is because the heavy particles of the mud and other suspended matter gravitate toward the bottom of the tool string where the contaminant densifies into a heavy layer of material. The longer the tool string is left downhole, the more the drilling mud is permitted to settle and congeal. In a perforating gun having a bar actuated gun firing head, for example, it is possible for the mud to densify about the gun firing head mechanism and become compacted and viscous to such an extent that the gun firing head cannot be impacted and detonated. The firing mechanism will require 20 ft-lbs of impact for detonation. Where the mud is permitted to settle and congeal, it may well be impossible to attain 20 ft-lbs of impact from the bar. Thus, it is an advantage to prevent the mud and debris from collecting around the firing mechanism and to permit circulation for the removal of any packed mud. Further, it is advantageous to be able to isolate all of the tubing string above the gun and yet easily gain access to the gun firing head so that no contamination thereof can occur.

When an upper tubing string is lowered downhole through the casing and sealed within a packer device, provision must be made by which the upper tubing string can sealingly mate with the lower tubing string in proximity of the packer device. As the upper tubing string is mated with the lower tubing string, fluid is usually displaced from the lower casing annulus, and therefore provision must be made for accommodating this flow of fluid from the lower to the upper annulus, or otherwise, it will be impossible for the packer, or the lower tubing string, to receive the lower end of the upper tubing string due to the incompressibility characteristics of the well fluid.

It would be desirable to be able to overcome the above problems during the completion of a cased wellbore. Method and apparatus by which these problems are advantageously overcome is the subject of the present invention.

Reference is made to the Vann U.S. Pat. Nos. 3,706,344; 3,812,911; 3,871,448 and 4,140,188 for further background of completion techniques similar to the above-described procedure. Reference is also made to the copending patent application previously cross-referenced.

SUMMARY OF THE INVENTION

This invention comprehends both method and apparatus for completing a cased borehole, wherein a packer device is anchored downhole within the casing, and a perforating gun is suspended in underlying relationship respective to the packer by means of a unique housing. The housing includes lateral flow ports formed therein at a location spaced below the packer device.

An upper tubing string is provided with a seal assembly at the lower end thereof, and an extension tube depends from the lower end of the seal assembly. There are lateral flow ports in the extension tube adjacent to the bottom of the seal assembly. The lateral flow ports are connected to a one-way valve means which is included between the seal assembly and the upper end of the extension tube so that one-way flow can occur from the lower annulus and into the tubing when the seal assembly is seated within the housing.

A gun firing head is connected to the upper end of the perforating gun and extends into the tubing which connects the gun to the housing, and is accessible to the axial passageway formed by the housing, packer, extension tube, seal assembly, and upper and lower tubing strings.

The upper tubing string is run into the casing, downhole until the lower end of the extension tube is in close proximity to the gun firing head, while the seal assembly is unseated respective to the seal housing. Clean fluid is pumped down the upper string, through the seal assembly, through the extension tube, and into the interior of the hosing, thereby displacing well fluid which is forced to flow up the lower inner annulus, formed between the lower tubing and the extension tubing, through the packer device, up the upper annulus, and to the surface of the ground, thereby cleaning debris from proximity of the gun firing head so that the gun firing head is accessible through the central passageway of the tool string.

The upper tubing string is next manipulated to engage the seal assembly with the seal housing. During this time, fluid displaced from the vicinity of the gun firing head by this action is forced to flow through the lateral ports, through the one-way valve, into the central passageway of the seal assembly, and uphole toward the surface of the ground.

A gun firing device is now sent downhole through the central passageway of the tool string and into operative association with the gun firing head, thereby detonating the shaped charges of the perforating gun. This action perforates the casing in proximity of a hydrocarbon-containing formation, and production occurs through the perforations, into the lower outer annulus, through the lateral ports of the housing, into the lower inner annulus, through the one-way valve assembly, into the central passageway, and uphole through the upper tubing string to the surface of the ground.

In one form of the invention a telescoping extension tube is employed by which the trigger device of the gun firing head is received within the lower terminal end of the telescoping extension tube. The upper string manipulates the lower extension tube which telescopes together to assure that the lower end thereof is in close proximity to the trigger device of the gun firing head, thereby making certain that debris is washed uphole away from the perforating gun apparatus.

In another form of the invention a frangible barrier is interposed within the tool string at a location between the gun firing head and the packer device. The barrier includes a pressure equalizing piston having a central passageway formed therethrough which is closed by the aforesaid barrier. As the extension tube is lowered toward the gun firing head, debris is washed uphole, and thereafter, the lower terminal end thereof engages and removes the barrier, thereby communicating the gun firing head with the interior of the extension tube which also forms part of the central passageway.

Accordingly, a primary object of the present invention is the provision of method and apparatus by which debris can be washed from a selected area located downhole in a cased borehole.

A further object of the present invention is the provision of method and apparatus by which debris which obscures a gun firing head can be displaced uphole therefrom.

Still another object of the present invention is the provision of both method and apparatus by which a cased wellbore can more precisely and reliably be completed.

A still further object of the present invention is the provision of method and apparatus for displacing debris from a selected area of the interior of a tool string of a permanent completion apparatus to enable subsequent detonation of a perforating gun to more efficiently be carried out.

One of the advantages of the present system is that one has many opportunities to overcome any problems which may be encountered during the process. For example, one can stop at any time above the packer to run another log to determine one's location.

These and various other objects and advantages of the invention will become readily apparent to those skilled in the art upon reading the following detailed description and claims and by referring to the accompanying drawings.

The above objects are attained in accordance with the present invention by the provision of apparatus fabricated in a manner substantially as described in the above abstract and summary.

DETAILED DESCRIPTION OF THE PREFERRED EMBODIMENTS

Figure 1:
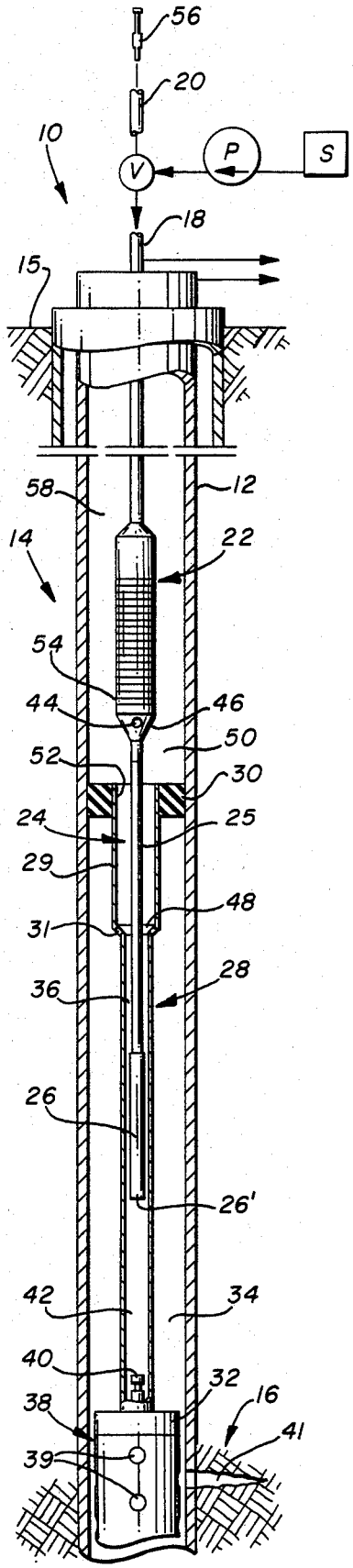
FIG. 1 is a partly schematic, partly diagrammatic, partly vertical cross-sectional elevational view of a well bore having apparatus associated therewith by which the present method can be carried out.

The drawings, in particular FIG. 1, disclose a wellhead 10 at the upper terminal end of a cased borehole 12 which extends downhole at 14 below the surface 15 of the ground, and penetrates a hydrocarbon-containing formation 16.

An upper tubing 18 is connected to lubricator 20 in the usual manner. A packer seal device 22 is connected to the upper tubing string and terminates in an extension tubing 24 at the lower marginal end thereof. The extension tubing includes telescoping sections 25 and 26 which can be telescopingly shortened by slidably receiving one illustrated section within the other.

A housing 28 extends downhole from a packer 30 and communicates with a gun firing head 32. The housing and gun form a lower outer annular area 34 respective to the casing of the borehole, while the extension tubing forms a lower inner annular area 36 respective to the interior wall surface of the housing and lower tubing.

A jet perforating gun 38, preferably a large casing type gun has large, shaped charges 39 incorporated there-within in a manner as taught in the Vann U.S. Pat. No. 4,140,188, for example. A trigger device 40 associated with the gun firing head detonates the shaped charges which perforate the casing, thereby forming tunnels 41 back up into the formation.

The trigger device is centrally arranged within a central passageway which extends unobstructed uphole to the lubricator 20, with the passageway being formed by a central string comprised of tubing 18, packer seal device 22, one-way valve assembly 46 having lateral flow port 44 formed therein, extension tubing 24, and a packer to gun sub 28 which includes a sealing housing 29 having perforations 31 formed at the lower end thereof.

OPERATION

After the casing has been cemented into place, the drilling rig can be used to install the packer and gun downhole in the position illustrated in FIG. 1. The apparatus remains in this dormant configuration until it is time to complete the wall.

As shown in FIG. 1, the tool string includes a packer to gun sub 28 having a seal housing 29 with perforations 31 and a perforating gun 38 disposed on the end of tubing 24. Gun firing head 32 has a trigger device 40 which detonates shaped charges 39 when the trigger device is impacted by the bar 56. This tool string is attached to a permanent packer 30, and the packer 30 is lowered into the well on a wireline. A wireline setting tool located on the lower end of the wireline sets permanent packer 30 for the support of the tool string within the well and locates the perforating gun 30 adjacent formation 16 to be perforated.

Prior to setting packer 30, a log is run of the well to be sure that perforating gun 33 is positioned adjacent production zone 16, thereby to position perforations 41 in the production zone 16.

Once permanent packer 30 has been set and the setting tool removed from the well, a tubing string 18 with a packer seal device 22 having a downwardly extending tubing extension 24 with telescoping sections 25, 26 is lowered into the well to a position as shown in FIG. 1. Extension tubing 24 now extends through permanent packer 30 the maximum amount that avoids packer seal device 22 sealingly engaging the interior of permanent packer 30.

A log may again be run to determine the proper positioning of all the apparatus. The log permits the determination of the number of subs required to connect the tubing string 18 at the surface such that extension tubing 24 and sealing device 22 are properly positioned with respect to packer 30.

A circulation fluid such as water, diesel, light crude or distillate, or nitrogen is pumped down tubing string 18 and extension tubing 24 to wash out the mud which ran in as string 18 and tubing 24 were lowered into the well.

Figure 2:
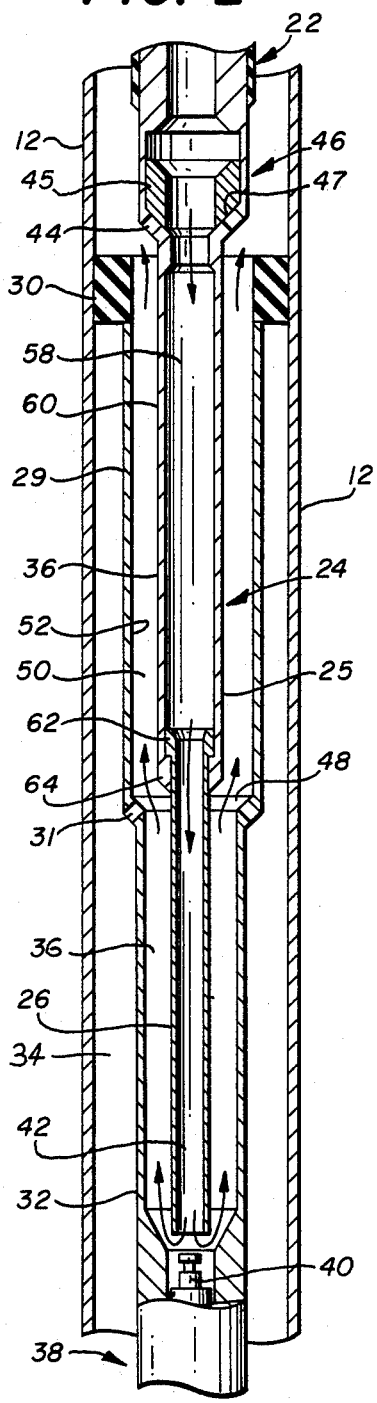
FIG. 2 is a fragmentary, part cross-sectional view which discloses apparatus similar to the apparatus of FIG. 1.

The seal assembly illustrated in FIG. 2 is supported in the open position relative to the seal housing. Accordingly, flow can occur down through the central passageway 58 of the central string 60, and since the outflow port 44 of one-way valve assembly 46 is in the closed position, flow is forced to continue down to the terminal end 26' of the extension tube. This action causes fluid to be displaced from the lower inner annulus as the upper tubing 18 continuously lowers the central string, thereby forcing debris at 36 to move uphole away from proximity to the gun firing head.

Figure 3:
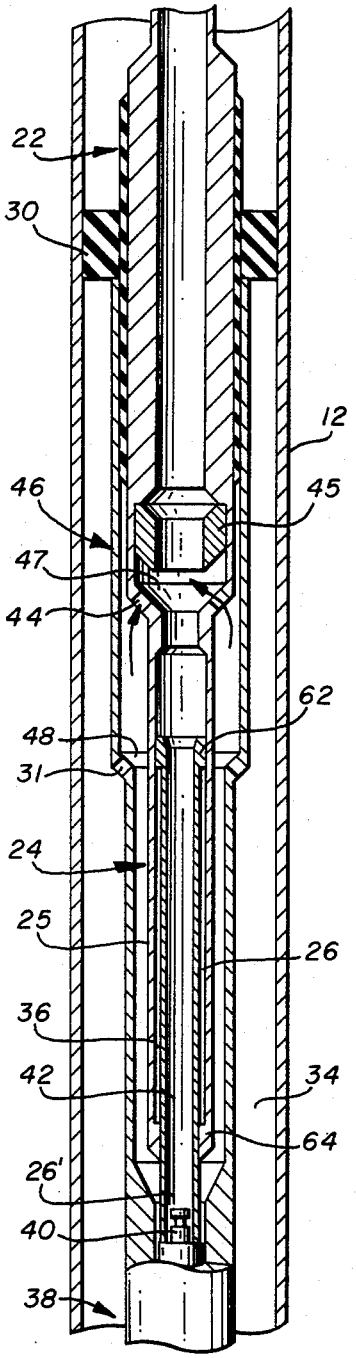
FIG. 3 illustrates the apparatus of FIG. 2 in an alternate operative configuration.

As the upper tubing string is set down, sections 26 and 36 telescope together by means of slip joints 62 and 64. After the upper tubing string has been set down and the apparatus assumes the configuration diagrammatically illustrated in FIG. 3, it will be noted that there is an unobstructed flow path from the trigger of the gun firing head, uphole to the wellhead. At this time, port 31 communicates the lower outer annular area with the lower inner annular area, and at the same time, valve element 45 is seated against valve seat 47 (see FIG. 2, for example) thereby closing the one-way flow port 44.

Once sealing device 22 sealingly engages packer 30, the pumping of circulating fluid will stop. Since the information has not yet been perforated, it is not possible to force more fluid into the bottomhole below the packer after the packer seals the annulus.

A sinker bar 56, as illustrated in FIG. 1, is dropped down the central string by utilizing a lubricator. The sinker bar freely falls down through the central passageway until it is arrested by the trigger of the gun firing head, and the resultant dissipation of energy actuates the gun firing head, which in turn detonates each of the shaped charges of the casing gun. The shaped charges each form a perforation and tunnel which communicate the formation with the lower outer annulus of the wellbore, and consequently, production flows at 41 through the casing perforations, into the lower outer annulus, uphole and through the lower set of ports 31 whereupon the production enters the lower inner annulus.

The pressure differential across the one-way valve assembly causes valve element 45 to move uphole, thereby opening port 44 so that production enters the central passageway and flows through the seal assembly, packer, and up the tubing string to the surface of the ground where the production can be gathered and tied into a tank farm or the like.

The detonated apparatus disclosed herein can be left downhole within the borehole until some subsequent time when conditions require that the wellbore be entered for one reason or another. On the other hand, if deemed desirable to do so, a releasable coupling device, such as set forth in the Vann U.S. Pat. No. 3,966,236, can be interposed below the packer in the manner set forth in U.S. Pat. No. 3,990,507.

Where an underbalance for backsurging is desired, the underbalance is created by removing the mud from within tubing 18 by using nitrogen before sealing device 22 sealing engages packer 30. The mud is initially removed through the circulation of lighter fluid down through tubing 18 and forcing the mud up the annulus to the surface.

After the mud inside tubing string 18 has been replaced with lighter fluid and sealing device 22 has been stabbed into packer 30, pressure can be bled off of the tubing string 18 to set the predetermined underbalance of pressure differential in preparation for perforation.

Depending upon the amount of underbalance or differential pressure desired, the lighter fluid in tubing 18 may be swabbed out and completely removed to obtain a maximum differential pressure or some predetermined column of lighter fluid may be maintained in tubing 18 to realize a predetermined pressure differential for backsurging. For example, seldom is it desired to have an underbalance greater than 5,000 psi. Where the formation pressure is greater than 5,000 psi, it would be desirable to maintain a hydrostatic head of lighter fluid in tubing 18 to limit the differential pressure to approximately 5,000 psi. Thus, the underbalance of differential pressure may be controlled by the weight of the circulating fluid in tubing 18 and the height of the column of that fluid in tubing 18.

Figure 4:
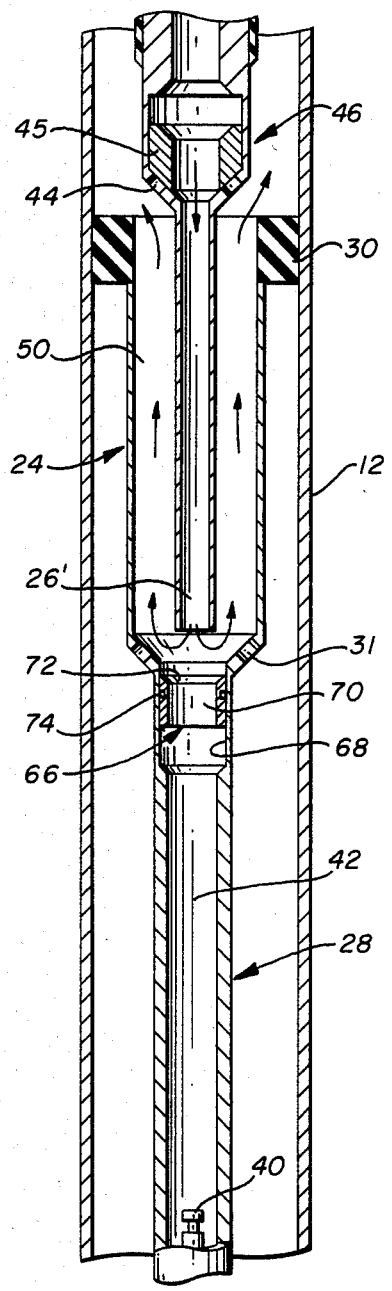
FIG. 4 is a fragmentary, part cross-sectional view of another embodiment of the apparatus shown in FIG. 1.
Figure 5:
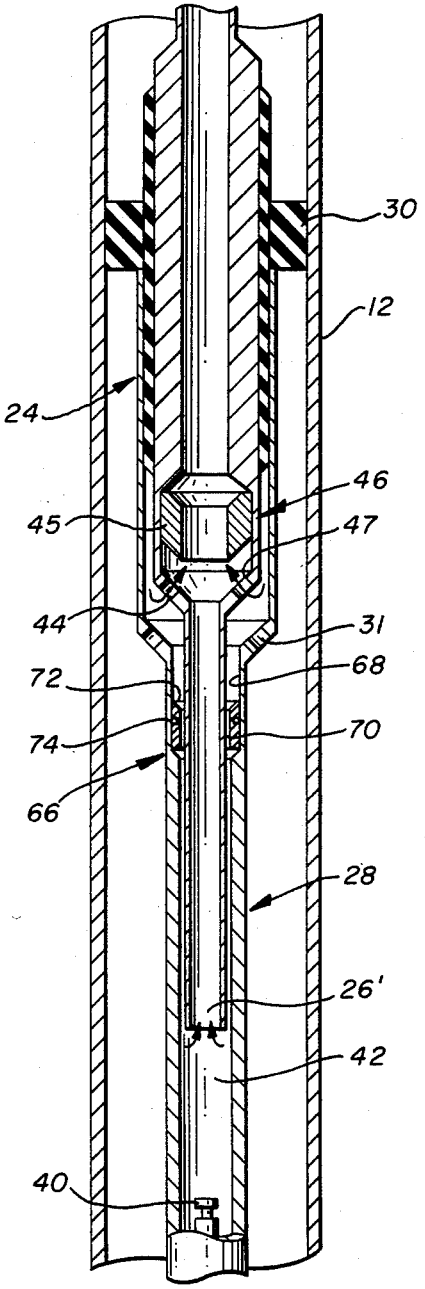
FIG. 5 illustrates the apparatus of FIG. 4 moved into an alternate position of operation.

In the embodiment of the present invention set forth in FIGS. 4 and 5, a pressure-equalizing piston 66 is reciprocatingly received within the enlarged cylindrical area 68 of the packer-to-gun-sub. The piston preferably is of annular construction and has a passageway 70 formed therethrough, through which the extension tube can be telescopingly received, with the extension tube having an inside diameter which permits the beforementioned sinker bar to travel therethrough.

The upper end of the piston is provided with a frangible member 72 which forms a barrier between the seal housing annulus 50 and the lower inner annulus 34. The frangible barrier preferably is in the form of a brass disk 0.005 inches thick, such as shimstock, for example, suitably mounted at the upper extremity of the piston to provide a closure means therefor. Seal 74 provides for sealed reciprocating movement relative to the piston and cylinder.

Ports 31 of the sub are located in close proximity to the barrier means. Accordingly, the extension tubing can be lowered into the illustrated position of FIG. 4, and a source S of clean fluid can be pumped by means of pump P down through the central passageway and into proximity with the barrier means, thereby removing debris from the top of the piston. As seen in FIG. 5, the upper tubing string can then be set down, whereupon the lower terminal end 26' of the extension tube penetrates the frangible disk as the seal assembly is telescopingly received in sealed relationship within the seal housing. The formation can now be communicated with the interior of the casing in the before-described manner.

It is considered within the scope of this invention to incorporate the seal housing within the packer device, or alternatively, to place the seal housing slightly above the packer device.

While a preferred embodiment of the invention has been shown and described, modifications thereof can be made by one skilled in the art without departing from the spirit of the invention.

I claim:

1. Method of completing a formation located downhole in a cased borehole comprising the steps of:

(1) connecting a casing gun in underlying relationship relative to a packer device and suspending the gun adjacent to a formation to be completed;

(2) forming a passageway from the gun to the packer, and placing a gun firing device within the passageway;

(3) forming a seal housing within said passageway; running a seal assembly having an attached extension tube downhole on the end of a tubing string such that the extension tube is positioned within the seal housing and forms an annulus therebetween;

(4) forming a flow path which extends from the surface of the ground, down through the tubing string, to said gun firing device, back up the annulus formed between the seal housing and extension tube, up the upper annulus between the casing and the tubing string, and to the surface of the ground, and flowing a washing fluid through the flow path thereby washing debris from about the firing device;

(5) seating the seal assembly within the seal housing; isolating the seal housing annulus from the upper annulus by lowering the tubing string until the seal assembly is seated within the seal housing;

(6) perforating the formation by passing a gun firing device actuator downhole through the tubing string to the gun firing device; and (7) producing the well by flowing the production from the formation, into the lower borehole annulus, into the seal housing, through the seal assembly, and up the tubing string to the surface of the ground.

2. The method of claim 1 and further including the step of actuating said gun firing device in response to impact so that the shaped charges of the perforating gun can be detonated by dropping a weight down the tubing string and into abutting engagement with the gun firing device.

3. The method of claim 1 and further including the step of interposing a barrier between the gun firing device and the seal housing; and, opening said barrier in response to the seal assembly being sealingly engaged with the seal housing.

4. The method of claim 1 and further including the steps of interposing a barrier between the gun firing device and the seal housing to protect the gun firing device from debris; and opening said barrier in response to the seal assembly being sealingly engaged with the seal housing;

actuating said gun firing device in response to impact so that the shaped charges of the perforating gun can be detonated by dropping a weight down the tubing string into abutting engagement with the gun firing device.

5. The method of claim 1 and further including the step of forming said flow path of step (4) by elevating said seal assembly relative to said seal housing so that countercurrent flow along two isolated flow paths occur through said packer device;

carrying out step (7) by placing a one-way valve means between said extension tube and said seal housing, and flowing said production through said valve means and into said seal assembly.

6. In a cased borehole having a perforating gun located adjacent to a formation to be completed, with said gun being supported below a packer device, with there being a central passageway extending from the surface of the ground, through the packer device, and to a gun firing head which detonates the shaped charges of the gun in response to actuation thereof, the method of completing said formation comprising the steps of:

cleaning debris from the vicinity of the gun firing head by circulating fluid down said central passageway to said gun firing head, and uphole through an annular area formed about said central passageway to the surface of the ground, thereby displacing fluid contained within said passageway and about said gun firing head with clean fluid;

isolating the annular area above the packer from the annular area below the packer;

running a gun firing device downhole through said passageway, into contact with said gun firing head, thereby detonating the shaped charges of the gun and perforating the casing in proximity to the formation;

producing the well by flowing production from the formation, through the perforations, into the lower annular area, uphole towards the packer and into the central passageway, and uphole to the surface of the ground.

7. The method of claim 6 and further including the steps of providing a one-way valve means for lateral flow from the lower annular area into the interior of the tubing string so that formation fluid can be conducted uphole to the surface of the earth.

8. Method of completing a well, comprising the steps of:

suspending a tool string from a packer within the well, the tool string includes a pipe with ports means and a perforating means disposed on the pipe with a firing apparatus extending into the pipe;

lowering a pipe string with a seal means, vent means, and collapsible wash pipe disposed thereon;

disposing the end of the wash pipe adjacent the firing mechanism;

circulating down through the wash pipe to wash the firing mechanism;

shortening the wash pipe;

sealing the pipe string and packer with the seal means;

activating the firing apparatus and detonating the perforating means; and producing the well by flowing the production fluids through the port means, vent means and up the pipe string.

9. Method of completing a well, comprising the steps of:

assembling a tool string comprising a pipe having port means, a barrier means, and a perforating means with a firing apparatus below the barrier means in the pipe;

filling the pipe below the barrier means with fluid;

lowering a pipe string with a seal means, vent means, and wash pipe disposed thereon into the well;

circulating down through the wash pipe;

penetrating the barrier means with the wash pipe;

sealing the pipe string and packer with the seal means;

actuating the firing apparatus and detonating the perforating means; and producing the well by flowing the production fluids through the port means, vent means and up the pipe string.

* * * * *